US007686131B1

(12) United States Patent
Osterkamp et al.

(10) Patent No.: US 7,686,131 B1
(45) Date of Patent: Mar. 30, 2010

(54) VEHICLE EXHAUST TIP ASSEMBLY

(75) Inventors: Dale F. Osterkamp, Novi, MI (US); Andrew J. Kurzawa, Romeo, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/335,710

(22) Filed: Dec. 16, 2008

(51) Int. Cl.

| | |
|---|---|
| ***F01N 13/08*** | (2010.01) |
| ***F01N 13/18*** | (2010.01) |
| ***F01N 1/02*** | (2006.01) |
| ***B60K 13/04*** | (2006.01) |
| ***B60R 19/02*** | (2006.01) |

(52) U.S. Cl. ..... 181/227; 181/228; 181/249; 181/282; 180/89.2; 293/113

(58) Field of Classification Search ..... 181/227, 181/228, 282, 249; 180/89.2; 293/113
See application file for complete search history.

(56) References Cited

U.S. PATENT DOCUMENTS

| | | | | |
|---|---|---|---|---|
| 2,841,348 | A * | 7/1958 | Stahlhuth | 248/65 |
| 2,850,314 | A * | 9/1958 | Haigh et al. | 293/113 |
| 2,992,035 | A * | 7/1961 | Tell et al. | 293/113 |
| 3,908,372 | A * | 9/1975 | Fowler et al. | 60/320 |
| 4,277,442 | A * | 7/1981 | Hergart | 422/119 |
| 4,730,852 | A * | 3/1988 | Arscott | 285/15 |
| 5,100,047 | A * | 3/1992 | Nakagawa et al. | 228/176 |
| 5,330,234 | A * | 7/1994 | Sweeny | 285/62 |
| 5,726,398 | A * | 3/1998 | Zahn et al. | 181/282 |
| 5,788,320 | A * | 8/1998 | Hanemaayer | 296/164 |
| 6,308,799 | B1 * | 10/2001 | Konstantakopoulos | 181/282 |
| 6,668,972 | B2 * | 12/2003 | Huff et al. | 181/256 |
| 6,962,230 | B2 * | 11/2005 | Hanaya et al. | 180/309 |
| 7,007,720 | B1 * | 3/2006 | Chase et al. | 138/110 |
| 7,152,710 | B1 * | 12/2006 | Huang et al. | 181/227 |
| 7,458,440 | B2 * | 12/2008 | Uegane | 181/228 |
| 2002/0079162 | A1 * | 6/2002 | Huff et al. | 181/282 |
| 2003/0062743 | A1 * | 4/2003 | Fujii et al. | 296/203.04 |
| 2005/0023076 | A1 * | 2/2005 | Huff et al. | 181/246 |
| 2007/0240932 | A1 * | 10/2007 | Van De Flier et al. | 181/228 |

* cited by examiner

*Primary Examiner*—Jeffrey Donels
*Assistant Examiner*—Christina Russell

(57) ABSTRACT

An exhaust tip assembly conducts hot engine exhaust from a muffler through an opening in a molded plastic bumper fascia. An exhaust pipe defining a cross-sectional flow area for the exhaust flow and has an inlet end attached to the muffler and an outlet end. The exhaust pipe has a flexible coupling portion intermediate the inlet end and the outlet end. A heat shield has a cross-sectional flow area greater than the pipe, and an inlet end attached to the outlet end of the pipe. A decorative bezel is attached to the heat shield at the outlet end of the heat shield. Fasteners fasten the heat shield to the fascia with the bezel located in the opening in the rear bumper fascia. During movement of the muffler, the bezel remains in the center of the opening as the flexible coupling portion of the exhaust pipe flexes.

2 Claims, 3 Drawing Sheets

VEHICLE EXHAUST TIP ASSEMBLY

FIELD OF THE INVENTION

The present invention relates to a motor vehicle exhaust system and more particularly to an exhaust tip assembly for communicating exhaust gas from a muffler through an opening in a molded plastic fascia at the rear of the vehicle.

It is well known in motor vehicles to provide a muffler that quiets the vehicle exhaust and to provide an exhaust pipe that extends from the muffler to a pipe tip that is situated beneath the rear bumper of the vehicle. The exhaust system, including the muffler and exhaust pipe are typically mounted on the vehicle by hanger straps that are somewhat flexible in order to accommodate the limited amount of relative motion between the exhaust system and the vehicle body in response to vehicle vibration and other events.

It is also known in modern vehicles to improve the appearance of the exhaust tip by using a steel exhaust pipe and then mounting a decorative bezel over the end of the pipe. The bezel may, for example, be stainless steel or chrome steel to provide improved appearance.

A difficulty with the aforedescribed exhaust tip solutions is that the relative vibration of the exhaust pipe can in some cases cause the exhaust tip to contact with the fascia causing noise, or in a worse situation, to cause a wearing or other unattractive condition.

Therefore, it would be desirable to provide an improved vehicle exhaust tip assembly which would eliminate the aforedescribed disadvantages.

SUMMARY OF THE INVENTION

An exhaust tip assembly conducts hot engine exhaust from a muffler through an opening in a molded plastic bumper fascia. An exhaust pipe defining a cross-sectional flow area for the exhaust flow has an inlet end attached to the muffler and an outlet end. The exhaust pipe has a flexible coupling portion intermediate the inlet end and the outlet end. A heat shield has a cross-sectional flow area greater than the pipe, and an inlet end attached to the outlet end of the pipe. A decorative bezel is attached to the heat shield at the outlet end of the heat shield. Fasteners fasten the heat shield to the fascia with the bezel located in the opening in the rear bumper fascia. During movement of the muffler, the bezel remains in the center of the opening as the flexible coupling portion of the exhaust pipe flexes.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings.

DETAILED DESCRIPTION OF THE EXEMPLARY EMBODIMENTS

The following description of certain exemplary embodiments is merely exemplary in nature and is not intended to limit the invention, its application, or uses.

Figure 1:
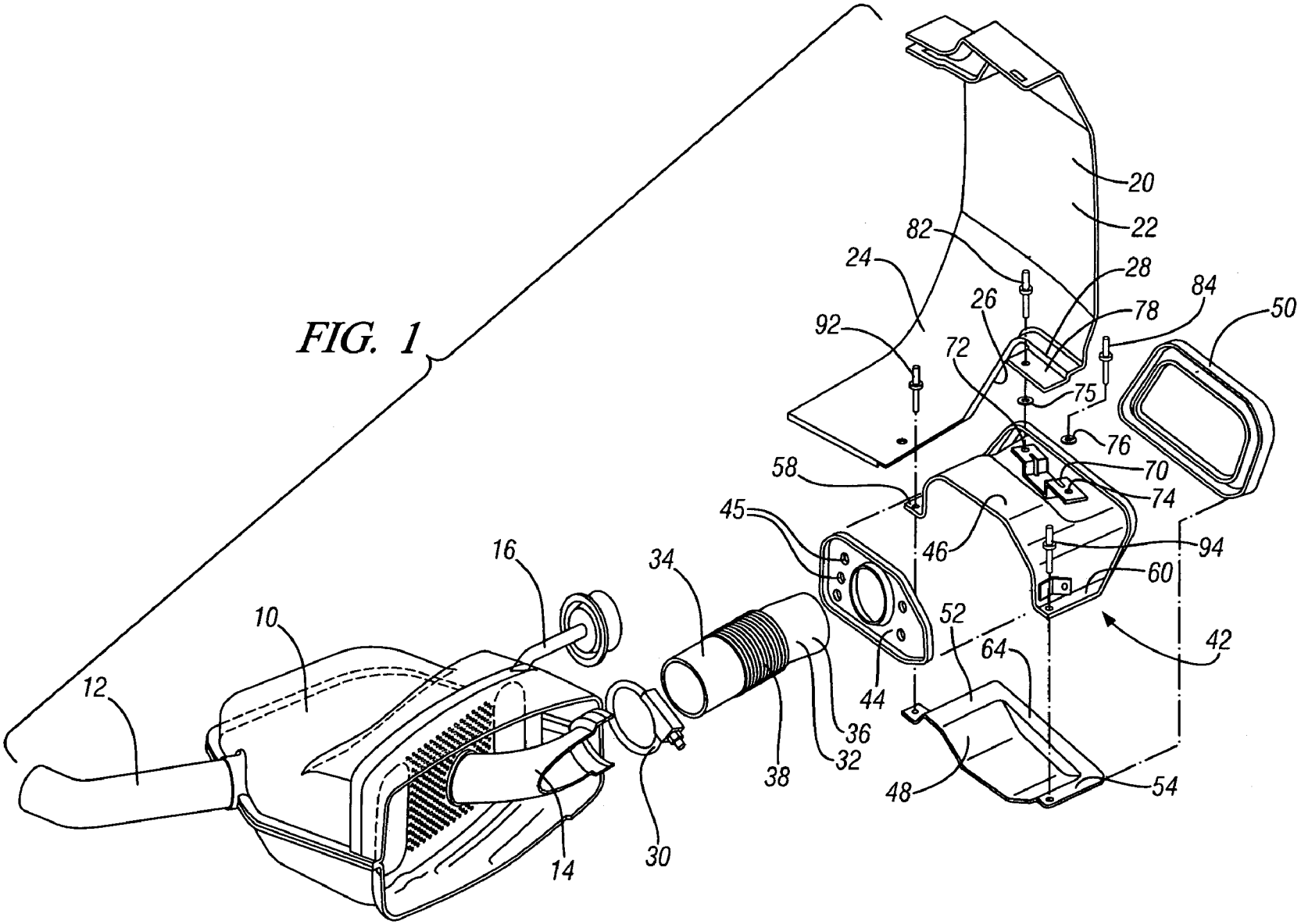
FIG. 1 is a perspective view of the exhaust tip assembly of this invention shown with the individual components thereof broken apart in an exploded view.

Referring to FIG. 1, the components of the exhaust tip assembly of this invention are shown in exploded view prior to their assembly. A vehicle muffler 10 is of any conventional design and includes an inlet 12 receiving exhaust gas from an engine, and an outlet pipe 14. The muffler 10 is suspended from the undercarriage of the vehicle body by a plurality of hangers, one of which is shown at 16. These hangers 16 support the muffler 10 but also accommodate some lateral and vertical movement of the muffler. The muffler hangers 16 typically includes an elastomeric vibration dampening element of some sort in order to dampen the vibrations and isolate the vibrations from transmission into the vehicle body.

The vehicle also includes a molded plastic fascia panel 20 that is suitably mounted onto the vehicle body structure to cover and conceal the rear bumper and other unaesthetic vehicle components. The fascia panel 20, as seen in FIG. 1, includes generally a vertical wall portion 22 and also a lower horizontal wall portion 24 that will reach forwardly a certain distance beneath the vehicle body to close out the area beneath the rear bumper. As seen in FIG. 1, the fascia 20 has an exhaust opening 26 therein which is provided in part by a wall flange 28 that extends at a 90-degree angle from the vertical wall 22 and from the horizontal wall 24. This wall flange 28 serves to stiffen the fascia panel 20 in the region of the opening 26, and will also provide an attachment point for the exhaust tip assembly, as will be discussed hereinafter.

Referring again to FIG. 1, it is seen that an exhaust pipe 32 is provided and that the exhaust pipe 32 includes an inlet end 34, an outlet end 36, and also a flexible coupling portion 38 that is provided intermediate the inlet end 34 and the outlet end 36. The flexible coupling portion 38 can be integrally provided in the pipe 32 via hydroforming or other manufacturing operation to provide a series of corrugations by which flexibility is furnished to the pipe 32.

FIG. 1 also shows a conventional pipe clamp 30 for attaching the pipe 32 to the outlet pipe 14 of the muffler 10.

FIG. 1 also shows a heat shield assembly, generally indicated at 42, that includes generally an inlet adapter plate 44, an upper shell 46, a lower shell 48 and a decorate bezel 50 of a decorative material such as chromed steel or stainless steel. As seen in FIG. 1, the lower shell 48 has flanges 52 and 54 extending along its lateral edges. Likewise, the upper shell 46 has flanges 58 and 60 extending along its lateral edges. These flanges will be welded together so as to attach the upper shell 46 to the lower shell 48. In addition, the adapter plate 44 will be welded to the upper shell 46 and the lower shell 48 at their inlet ends. The bezel 50 is welded to the upper shell 46 and lower shell 48 at their outlet ends. Accordingly, the heat shield assembly 42 will define and contain a cavity 64 having a cross-sectional flow area that is substantially greater than the cross-sectional flow area of the pipe 32. The adapter plate 44 has one or more holes 45 therein that will admit ambient air into the heat shield assembly 42 in order to facilitate the flow of exhaust through the heat shield assembly 42. Rather than holes 45, the adapter plate 44 can be stamped to have notches around its edges that will create a flow path for the ambient air to enter the heat shield assembly 42.

Figure 2:
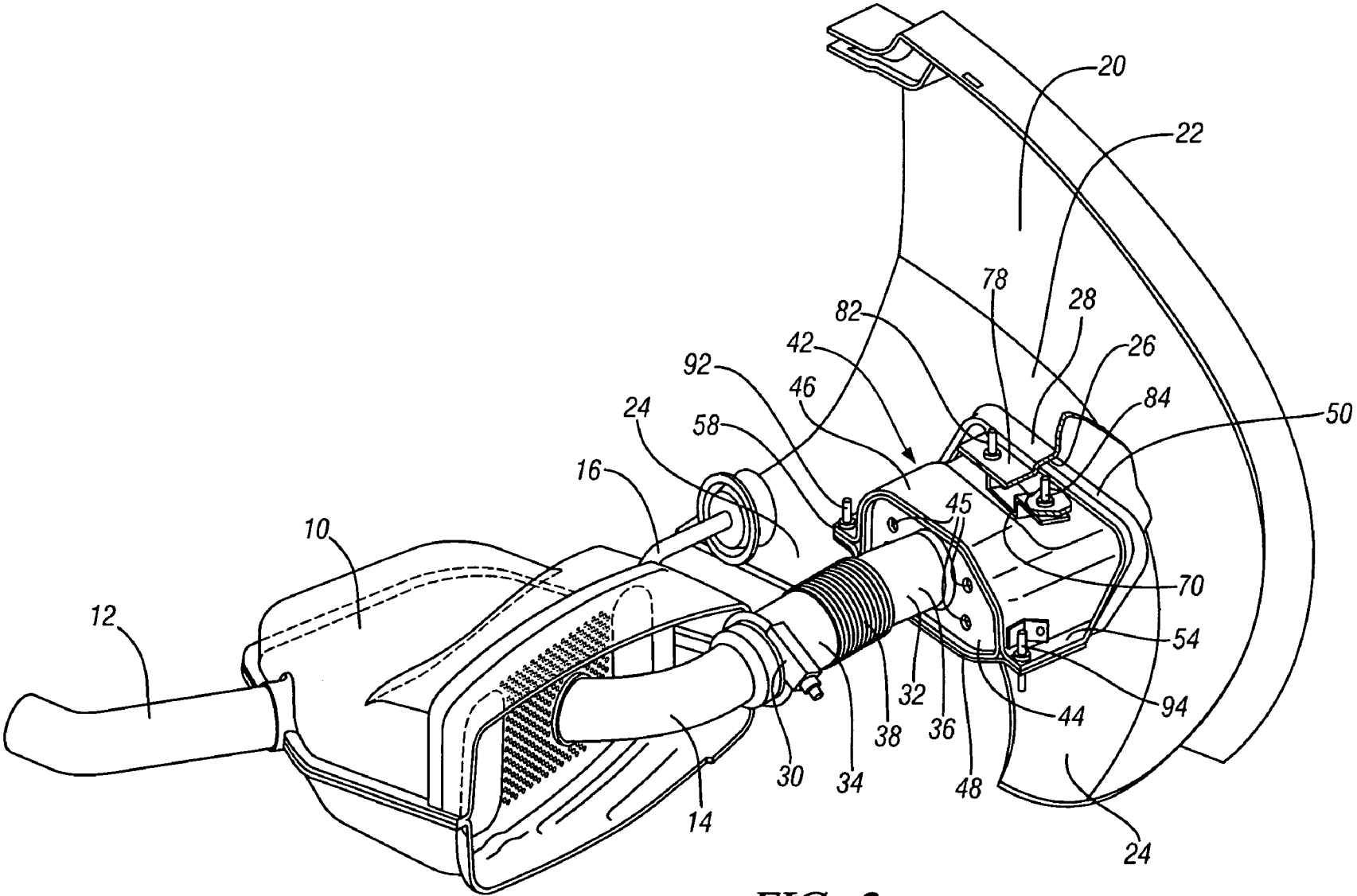
FIG. 2 is a perspective view showing the individual component parts of FIG. 1 having been assembled to the vehicle.
Figure 3:
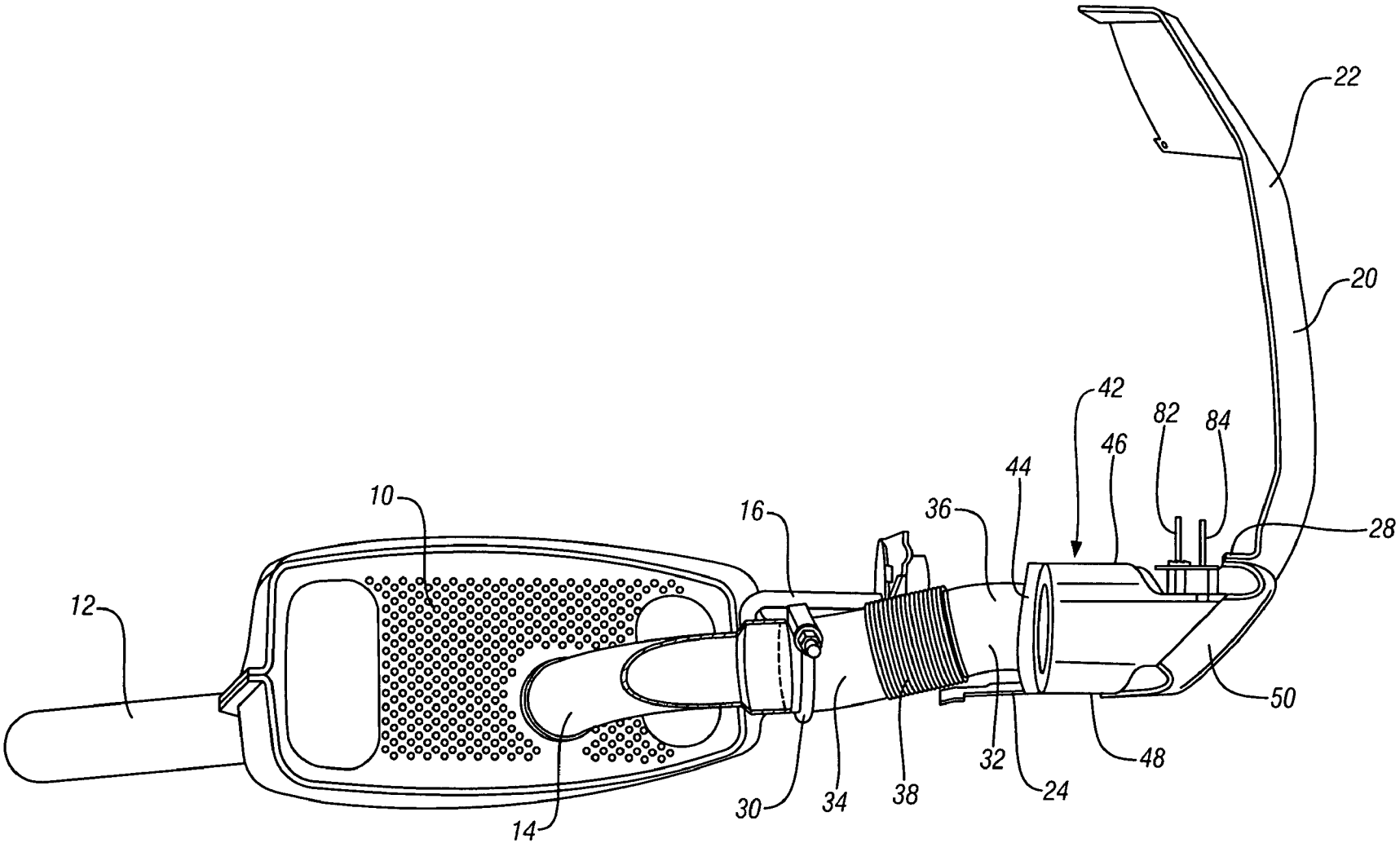
FIG. 3 is a longitudinal section view having parts broken away and in section showing the installed condition of the component parts.

As seen in FIG. 1, a bracket 70 is welded to the top of the upper shell 46 and has a pair of spaced apart apertures 72 and 74 that will underlie a mounting tab 78 that is formed integrally with the wall flange 28 of the fascia 20. Insulators 75 and 76, made of a heat insulating material such as silicone, EDM, or rubber are applied to the bracket 70. In FIG. 2, the insulators 75 and 76 are shown as washers, but can alternatively be pads of thermal insulating material that are adhesively secured to the bracket 70 or to the underside of the mounting tab 78 of the fascia panel 20. As seen in FIGS. 2 and 3, fasteners, such as pop rivets 82 and 84, will extend through the apertures 72 and 74 of the bracket 70 to attach the heat shield 42 to the fascia panel 20. In addition, it is seen that the welded together flanges 52 and 58 have mounting apertures that receive a pop rivet fastener 92 to attach the left side of the heat shield assembly 42 to the lower wall 24 of the fascia 20. Likewise, at the other side of the heat shield assembly 42, mounting apertures are provided in the flanges 54 and 60 and a pop rivet 94 is provided to attach those flanges to the horizontal wall 24 of the fascia 20.

If desired, the entire heat shield assembly 42, including adapter plate 44 upper and lower shells 46 and 48, bracket 70 and the bezel 50 will be welded together at the parts manufacturer and the pipe 32 is also welded to the adapter 44. This assembly is then attached to the fascia panel 20 by the pop rivets 82, 84, 92 and 94 prior to the fascia panel 20 being installed onto the vehicle body. Thus, only the pipe clamp 30 needs to be installed during the final vehicle assembly process.

FIGS. 2 and 3 show the exhaust tip assembly mounted in the vehicle body. As seen in FIGS. 2 and 3, the heat shield assembly 42 is attached to the fascia panel 20 by the pop rivets 82, 84, 92 and 94 so that there will be relatively little movement between the heat shield 42 and the fascia panel 20. Thus, the heat shield 42 will establish the bezel 50 at a certain location with respect to the flanged wall 28 defining the opening 26 in the fascia panel 20. In this way, the bezel 50 can be spaced from the fascia panel 20 at a certain distance to accommodate whatever slight relative motion might occur between the heat shield 42 and the fascia panel 20 via flexure of the plastic material of the molded fascia panel. In addition, it can be recognized that the heat shield 42, has several features that will isolate the molded plastic of the fascia panel 20 from deleterious effect of the heat made by the exhaust gases. In particular, the exhaust gases expand upon reaching the heat shield 42 due to the fact that the cross-sectional flow area of the cavity of the heat shield is substantially greater than the cross-sectional flow area of the pipe 32. And the outlet end 36 of the pipe 32 can be welded into the adapter plate 44 at a precise angle that will direct the exhaust gas in a precise direction that best aligns with the opening in the bezel 50, thereby minimizing the impingement of the exhaust stream on the heat shield. In addition, the heat that is transferred to the heat shield 42 by the exhaust gas can be dissipated by the flanges 52 and 58 of the heat shield 42 which will act as cooling fins to cool the heat shield. In addition, it is noted that the bracket 70 will space the heat shield from the wall flange 28 to isolate the plastic material of the wall flange from direct contact with the wall of the upper shell 46 of the heat shield.

It will also be understood that the relative motion between the muffler and the heat shield can be accommodated by the flexure of the flexible coupling portion 38 of the pipe 32. Thus, by virtue of the flexible pipe coupling 38, the heat shield and its decorative bezel 50 can be relatively fixedly mounted upon fascia panel 20 and centered within the opening 24 in the fascia panel 20 and yet the muffler 10 can have its normal range of motion to accommodate vibration and inertial forces that are experienced by the muffler during operation of the motor vehicle, for example when traversing a rough road surface.

What is claimed is:

1. An exhaust tip assembly for ducting engine exhaust from a muffler through an opening in a plastic rear bumper fascia, comprising:

an exhaust pipe defining a cross-sectional flow area for the exhaust flow and having an inlet end attached to the muffler and an outlet end; said pipe having a flexible coupling portion hydroformed therein intermediate the inlet end and the outlet end;

a heat shield having a cross-sectional flow area greater than the pipe, and having an inlet end attached to the outlet end of the pipe also having an outlet end, said heat shield including upper and lower stamped shells having flanges welded together, and an adapter plate attached to upper and lower shells and to the outlet end of the pipe, said adapter plate having air flow openings therein to admit ambient air into the heat shield sufficient that the velocity of the exhaust flow is not unduly diminished as the exhaust gas enters the cross-sectional flow area of the heat shield;

a decorative bezel attached to the heat shield at the outlet end of the heat shield;

a mounting bracket provided on the upper shell;

fasteners fastening the mounting bracket and the flanges of the upper and lower shells to the fascia with the bezel located in the center of the opening in the rear bumper fascia;

and said outlet end of the pipe being welded to the adapter plate at a precise angle that will direct the exhaust gas in a precise direction that best aligns with the opening of the bezel and directs the exhaust gas to flow through the heat shield with a minimum of impingement on the heat shield whereby upon motion of the muffler relative to the vehicle the flexible coupling portion of the exhaust pipe yields to permit the outlet end of the pipe to remain at the precise angle at which it was welded to the adapter plate as the bezel remains at its location within the opening in the fascia.

2. The exhaust tip assembly of claim 1 having heat insulating material positioned between the heat shield assembly and the plastic fascia where needed to insulate a plastic fascia panel from the heat shield assembly.

* * * * *